United States Patent [19]

Beckman et al.

[11] 4,449,893

[45] May 22, 1984

[54] APPARATUS AND METHOD FOR PIEZOELECTRIC PUMPING

[75] Inventors: John B. Beckman, Cedartown; Martin J. Blickstein, Austell, both of Ga.

[73] Assignee: The Abet Group, Rome, Ga.

[21] Appl. No.: 374,890

[22] Filed: May 4, 1982

[51] Int. Cl.[3] ..... F04B 43/12; F04B 45/08

[52] U.S. Cl. ..... 417/322; 417/412; 417/474

[58] Field of Search ..... 417/322, 412, 474

[56] References Cited

U.S. PATENT DOCUMENTS

| | | | |
|---|---|---|---|
| 2,971,471 | 2/1961 | Huebschman | 417/322 |
| 3,107,630 | 10/1963 | Johnson et al. . | |
| 3,150,592 | 9/1964 | Stec . | |
| 3,215,078 | 11/1965 | Stec . | |
| 3,270,672 | 9/1966 | Haines et al. . | |
| 3,361,067 | 1/1968 | Anderson . | |
| 3,465,732 | 9/1969 | Kattchee . | |
| 3,753,426 | 8/1973 | Lilley . | |
| 3,768,931 | 10/1973 | Willis, Jr. . | |
| 3,840,758 | 10/1974 | Zoltan . | |
| 3,963,380 | 6/1976 | Thomas, Jr. et al. . | |
| 4,115,036 | 9/1978 | Peterson | 417/322 |
| 4,231,287 | 11/1980 | Smiley . | |

FOREIGN PATENT DOCUMENTS

| | | | |
|---|---|---|---|
| 3007001 | 9/1981 | Fed. Rep. of Germany | 417/322 |
| 53-27103 | 3/1978 | Japan | 417/322 |

*Primary Examiner*—Richard E. Gluck

*Attorney, Agent, or Firm*—Jerry W. Mills; Gregory M. Howison; Nina Medlock

[57] ABSTRACT

A method and apparatus of pumping a fluid by means of a piezoelectric pump is provided. All moving parts, including the valves and impeller, are piezoelectrically motivated. The preferred embodiment includes a piezoelectric ceramic tube having conductive bands adhered to the outer surface. The conductive bands and an inner surface electrode define tube regions which serve as valve and reservoir pump regions.

14 Claims, 11 Drawing Figures

APPARATUS AND METHOD FOR PIEZOELECTRIC PUMPING

TECHNICAL FIELD

This invention relates to pumping of fluids by means of a piezoelectric tube, and more particularly to piezoelectric pumping where all moving parts are piezoelectric motivated.

BACKGROUND ART

Considerable effort has been expended in recent years to develop high-reliability, low flow-rate, miniature pumps. Piezoelectric technology has played a significant part in this effort. The development in this area has lead to several pump designs where part of the pump assembly uses the piezoelectric effect, while the balance of the design retains conventional approaches. For example, in U.S. Pat. No. 3,215,078 to Stec, a piezoelectric tube is used for an impeller, but not for valving. U.S. Pat. No. 3,963,380 to Thomas use piezoelectric impellers and magnetic valves. U.S. Pat. No. 3,107,630 to Johnson uses a piezoelectric impeller with spring-loaded valves. U.S. Pat. No. 3,150,592 to Stec comes closest to an all-piezoelectric design, but still requires mechanical check valves.

Hybrid piezoelectric-mechanical assemblies, such as those in the above-referenced prior art, suffer a number of significant limitations. As a primary consideration, the mechanical parts of these prior art assemblies add mass and friction to the design, thereby increasing both energy requirements and operational wear, as well as inversely reducing reliability. An additional drawback of such hybrid assemblies is the increased time factors associated with mass and friction. Increased time factors reduce efficiency as well as limit the availability of miniature control devices, such as integrated circuit microprocessors. Another drawback of hybrid pumps is the noise commonly associated with any mechanical device. Attempts to limit such noise usually contribute to inefficiency and increase the size of the overall device. Further, hybrid assemblies must have sufficient size to accommodate the mechanical components, and this factor contributes to the difficulty in miniaturizing such pumps.

Accordingly, a need has arisen for a pump wherein all moving parts are piezoelectrically motivated.

DISCLOSURE OF THE INVENTION

The present invention provides a method and apparatus of piezoelectric pumping wherein all moving parts, including the valves and impeller, are piezoelectrically motivated. A plurality of piezoelectric ceramic tube regions, either in monolithic or detached sections, function as valves or impellers depending on the phase relationship of electrical charges applied to such tube regions as well as the space relationship of such tube regions.

BRIEF DESCRIPTION OF THE DRAWINGS

A more complete understanding of the invention and its advantages will be apparent from the following Detailed Description taken in conjunction with the accompanying Drawings in which.

DETAILED DESCRIPTION

Figure 1:
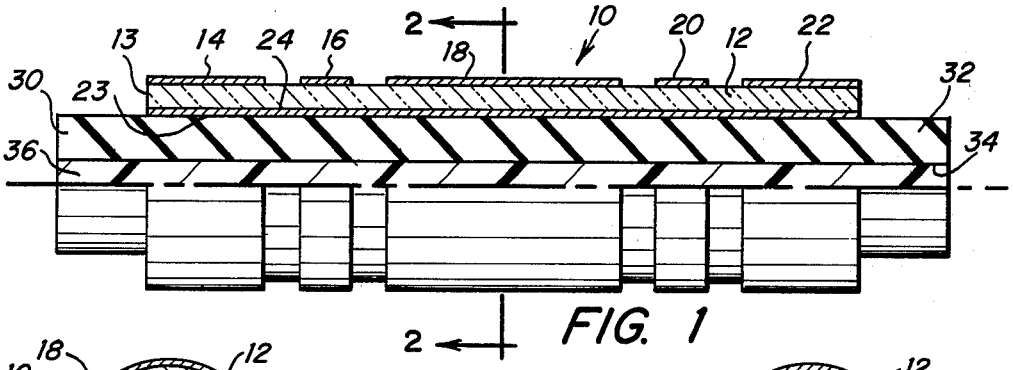
FIG. 1 is a partially broken away side view of a piezoelectric pump constructed in accordance with the invention.
Figure 2:
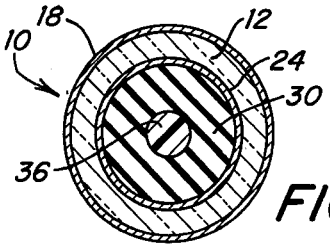
FIG. 2 is a sectional view of FIG. 1 taken along lines 2—2 of FIG. 1.

Referring initially to FIGS. 1 and 2, pump 10 includes piezoelectric ceramic tube 12 with conductive metal bands 14, 16, 18, 20 and 22 fired or otherwise adhered to outer surface 13 of tube 12. Bands 14, 16, 18, 20 and 22 are electrodes adapted to apply electric potential to outer surface 13. Electrode 24, extends across the entire inner surface 23 of tube 12.

Pump 10 includes core 30, which in the preferred embodiment is a resilient body constructed of an elastomeric substance such as silastic rubber. Core 30 has an outer surface 32 and an inner surface 34. Outer surface 32 is attached to electrode 24 for comovement with tube 12. Core pin 36 is disposed within inner surface 34 of core 30. In the preferred embodiment, core pin 36 is manufactured of a solid incompressible material.

Figure 3:
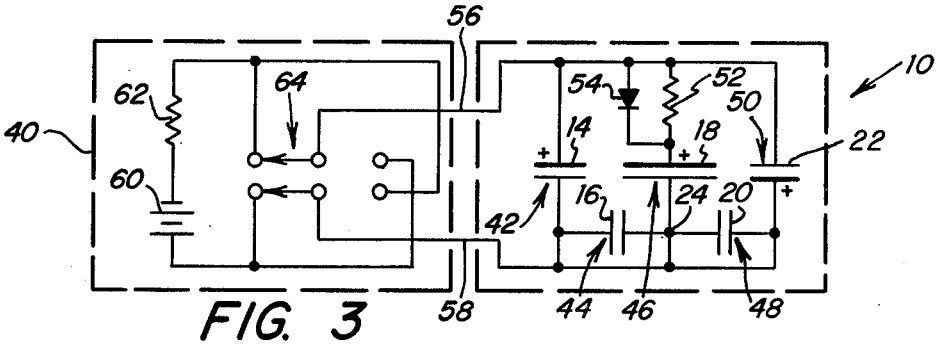
FIG. 3 is a schematic representation of the pump of FIG. 1 and of control circuitry adapted for use with the invention.

Referring now to FIG. 3, pump 10 and power supply 40 are represented in symbolic schematic form. Piezoelectric ceramics, such as the material of which tube 12 is constructed, are high dielectric materials, and therefore produce relatively high capacity between inner electrode 24 and each of conductive bands 14, 16, 18, 20 and 22, as well as between adjacent conductive bands 14, 16, 18, 20 and 22. Accordingly, each of the conductive bands in conjunction with the inner electrode defines a tube "region" which may be illustrated as a capacitor. Thus, conductive band 14 and inner electrode 24 form tube region 42, conductive band 16 and inner electrode 24 form tube region 44, conductive band 18 and inner electrode 24 form tube region 46, conductive band 20 and inner electrode 24 form tube region 48, and inner electrode 22 and inner electrode 24 form tube region 50. Tube regions 42 and 46 are poled oppositely to tube region 50, that is, positive conductive band 14 and positive conductive band 18, through resistor 52 and diode 54, are connected to power supply 40 through line 56, while conductive positive band 22 is connected to power supply 40 through line 58.

Power supply 40 is composed of DC power source 60, having system resistance 62, and switch 64. Switch 64 is symbolically illustrated as a DPDT switch. It will be understood that the invention is not limited to such an arrangement, but could include a battery and a variable voltage multiplier or an electronic integrated circuit, whose switching rate might be variable, or some other dual polarity switch circuit. Power supply 40 switches the output of battery 60, through system resistance 62, to lines 56 and 58 connected to the center portions of switch 64. In the preferred embodiment, switch 64 is alternated from one pole to the other at a regular cycle rate to produce a square wave output having a known frequency.

In operation, tube region 42 functions as an "In" valve, tube region 46 functions as a "Reservoir", and tube region 50 functions as an "Out" valve. Tube regions 44 and 48 perform a shielding function which will be described in more detail below. The piezoelectric ceramic material of which tube 12 is constructed has the characteristic of expanding in the direction in which it is "poled". As described above, "In" valve tube region 42 and "Reservoir" tube region 46 are poled oppositely to "Out" Valve tube region 50. This means that "In" valve region 42 and "Reservoir" region 46 expand when a positive voltage is applied to line 56, while "Out" valve region 50 contracts under the same circumstance. Conversely, "In" valve region 42 and "Reservoir" region 46 contract when a positive voltage is applied to line 58, while "Out" valve region 50 expands under this condition.

As shown in FIG. 3, "Reservoir" region 46 is connected to power supply 40 through a parallel diode-resistor circuit composed of resistor 52 and diode 54. Diode 54 acts as a selective switch. When line 56 is positive, diode 54 short circuits resistor 52 reducing the charging time constant of the "Reservoir" region 46 capacitance. In the reverse circumstance, i.e., line 58 being positive, the diode is reverse-biased, permitting resistor 52 to become part of the "Reservoir" region 46 discharge time constant.

Figure 5:
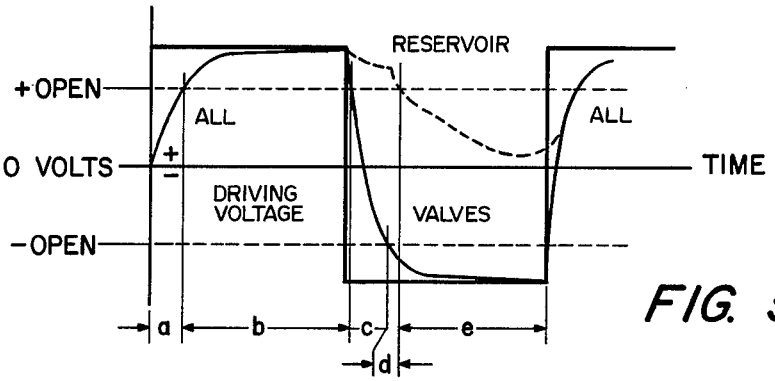
FIG. 5 is a graph illustrating the operation of the present invention.
Figure 4A:
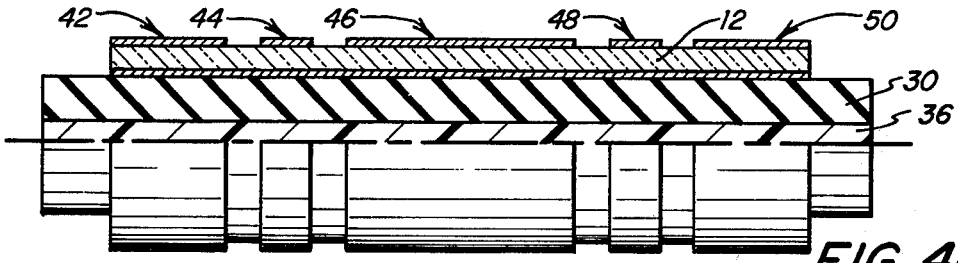
FIGS. 4*a–e* illustrate one cycle of the pump of FIG. 1.

Referring now to FIGS. 4*a*–4*e* and FIG. 5, the operation of pump 10 through one cycle may be more clearly understood. The letters "a", "b", "c", "d", and "e" on FIG. 5 correspond to the reference letters of FIGS. 4*a*–4*e*. Thus, FIG. 4*a* illustrates pump 10 in the time range referenced by letter "a" in FIG. 5, and so forth. In FIG. 5, the heavy line designates the driving voltage of power supply 40 while the lighter line represents the status of "In" and "Out" valves. The dashed line represents the status of the "Reservoir". FIG. 5 shows the electrical performance of "In" valve region 42, "Reservoir" region 46 and "Out" valve region 50. During positive charging, all three regions charge together, that is, they are all at the same potential at the same time. When switch 64 reverses, thereby causing negative charging, the "In" and "Out" valve regions 42 and 50 charge negatively together, but the "Reservoir" region 46 has the additional value of resistor 52 switched into its circuit causing it to charge negatively at a slower rate than the valve regions. As is evidenced from FIG. 5, the regions do not abruptly open or close, but rather open and close with reference to the thresholds represented by "+Open" and "−Open".

In FIG. 4*a* (time="a"), none of the valve or reservoir regions of tube 12 are expanded, and thus core 30 is fluid tightly sealed against core pin 36. The time lag shown in FIG. 5 in the letter "a" region is caused by the charge constant of the piezoelectric capacitances. Further, as shown in FIG. 5, the charge on "In" valve region 42 and "Reservoir" region 46 must exceed the "+Open" threshold before either region may pass fluid.

Figure 4B:
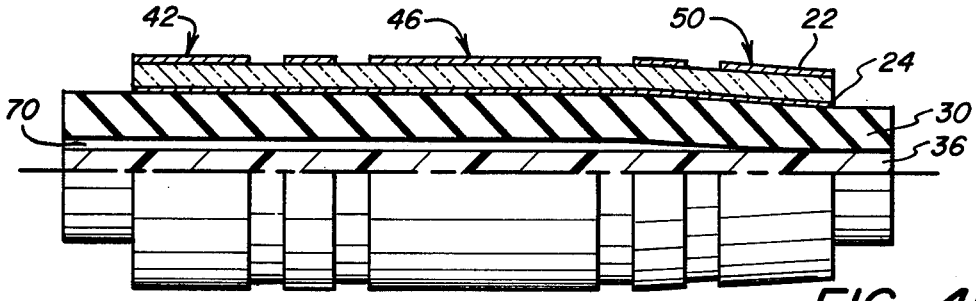

In FIG. 4*b* (time="b"), where the charge has exceeded the "+Open" threshold, "In" region valve 42 and "Reservoir" region 46 are open, defining a cavity 70. The opening of the "In" valve region 42 and "Reservoir" region 46 allows fluid from a fluid source (not shown) to enter cavity 70. It will be recalled that "Out" valve region 50, is oppositely poled to "In" valve region 42 and "Reservoir" region 46. Thus, in the time periods illustrated in FIGS. 4*a* and 4*b* and by the reference letters "a" and "b" in FIG. 5, "Out" valve region 50 is contracted, thereby fluid-tightly sealing and containing the fluid in cavity 70.

Figure 4C:
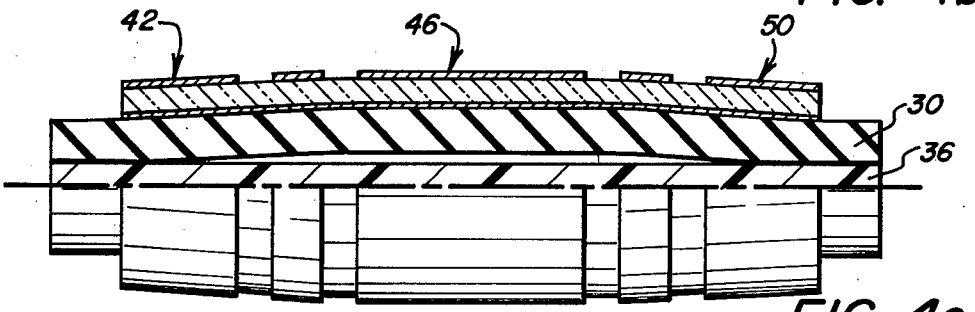

In FIG. 4*c* (time="c"), the charge on "In" valve region 42 has dropped below the "+Open" threshold and it is closed, but the charge has not yet reached a sufficient magnitude to open "Out" valve region 50. "Reservoir" region 46 is distended and full of fluid for two reasons. First, the charge on "Reservoir" region 46 drops at a rate considerably more slowly than the valve voltages. This is due to the addition of resistor 52 to the discharge time constant of "Reservoir" region 46 during the negative charging. Secondly, the fluid trapped in the portion of cavity 70 in the vicinity of "Reservoir" region 46 cannot escape in either direction, because both valves are closed.

Figure 4D:
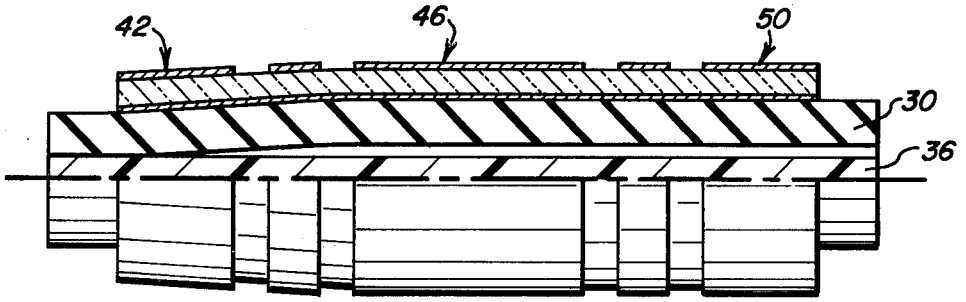

In FIG. 4*d* (time "d"), the driving voltage exceeds the "−Open" threshold, thereby opening "Out" valve region 50 due to its negative poling. The charge on "Reservoir" region 46, however, due to the delayed discharge rate, is still above the "+Open" threshold. Therefore, in FIG. 4*d* both "Reservoir" region 46 and "Out" valve region 50 are open, while "In" valve region 42 is closed. Further, "Reservoir" region 46 may now revert to the driving voltage signal path, because the trapped material in cavity 70 may now escape through the open "Out" valve region 50.

Figure 4E:
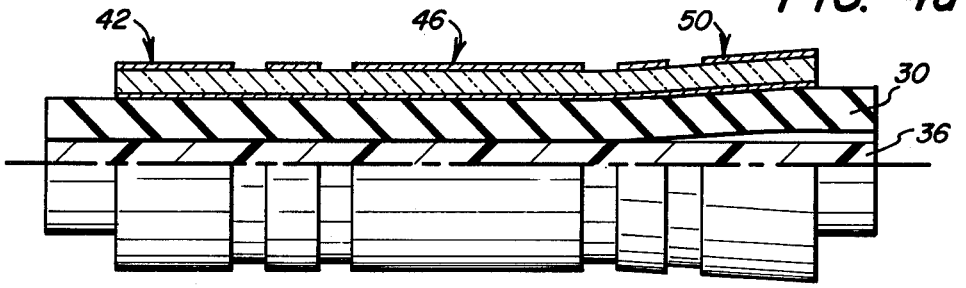

In FIG. 4*e* (time "e"), "Reservoir" region 46 has discharged to a level below the "+Open" threshold and is closed. "Out" valve region 50 is still open, and fluid in cavity 70 has been expelled.

The cycle shown in FIGS. 4*a*–*e* and FIG. 5 continues to repeat and thus drive the pump. The pump rate is a direct function of the voltage and the power supply frequency, either or both of which may be varied electronically, manually or automatically. Fluid viscosity will also affect the pump rate, but this factor can be manually or automatically compensated for by proper frequency or voltage adjustment.

An advantage of the present invention is that the forced distension of "Reservoir" region 46 in time region "d" causes a piezoelectric voltage to be generated on band 18. This voltage is measurably different than either the driving voltage or the voltage which would appear if the material in cavity 70 was compressible, such as air. This voltage difference can be sensed to determine if pump 10 is functioning properly is primed properly and has no compressible gases, such as air, in the fluid system.

It will be understood that the power supply and phase relationship described above in connection with FIGS. 3 and 5 are exemplary of the preferred embodiment where a common, square-wave signal is used to drive a pump and one or more of the tube regions are oppositely poled. An alternate method of driving the pump would involve the sequential application of voltages to commonly poled tube regions. Similarly, non-square wave signals may be used to drive the pump of the present invention.

Core pin 36 may be constructed of a molded plastic with flow enhancing grooves and retaining profiles molded thereon. Core 30 and core pin 36 extend beyond the ends of tube 12 to permit attachment of suitable hoses or tubes. The provision of resilient core 30 is intended to compensate for the normal bore variations in tube 12. By precision grinding the bore of tube 12, resilient core 30 may be eliminated, and the diameter of incompressible core pin 36 may be increased to fill the entire bore dimension of tube 12.

Further, core pin 36 is useful to achieve dimensional leverage. The actual radial movement of tube 12 when charged is very small, in the order of several ten thousandths of an inch. A volumetric change at the center would require a much greater radial change than the equivalent volumetric change some distance from the center when a core pin is used.

Figure 6:
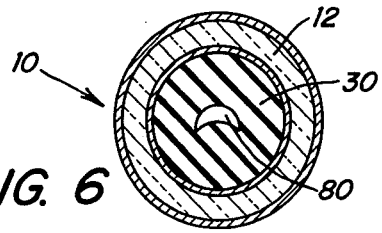
FIG. 6 is a sectional view of a first alternate embodiment of the present invention.

FIG. 6 illustrates an alternative embodiment where the core pin is eliminated, but dimensional leverage is retained. This is accomplished by means of a crescent-shaped cavity 80 formed in core 30. The embodiment shown in FIG. 6 has an additional advantage in that the radial pressures developed by the piezoelectric regions are normal to the cavity surfaces, and thus such pressures only negligibly effect efficiency of the pump.

Bands 16 and 20, together with inner electrode 24, define an "Input Guard" tube region 44 and "Output Guard" tube region 48. "Input Guard" region 44 is disposed between "In" valve region 42 and "Reservoir" region 46, while "Output Guard" region 48 is disposed between "Reservoir" region 46 and "Out" valve region 50. These guard regions are electrically at the same potential as inner electrode 24 under all circumstances, bands 16 and 20 being electrically connected to inner electrode 24. When pump 10 is in operation, the guard regions do not expand or contract, since bands 16 and 20 are connected to and have the same potential as electrode 24. The guard regions allow the valve regions and reservoir region to be electrically shielded from one another and thus be motivationally independent.

Figure 7:
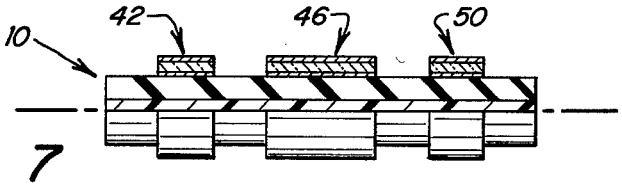
FIG. 7 is a side view of a second alternate embodiment of the present invention.

The guard regions may be eliminated by physically separating the valve and "Reservoir" regions as shown in FIG. 7. This configuration has an advantage in that the need for piezoelectric ceramic is reduced. Of course, the guard bands may also be eliminated in a single monolithic tube design if the regions are spaced a sufficient distance apart. In the preferred embodiment shown in FIG. 1, the provision of guard regions allows a reduction in axial length which will be desirable in many applications.

While particular embodiments of the present invention have been described in detail herein and shown in the accompanying Drawings, it will be evident that various further modifications are possible without departing from the scope of the invention.

We claim:

1. A pump comprising:

a piezoelectric tube having an outer surface and an inner surface defining a cavity;

an inner electrode disposed adjacent said inner surface;

first and second valve electrodes disposed adjacent said outer surface to define first and second valve regions;

a reservoir electrode disposed adjacent said outer surface to define a reservoir region interposed between said first and second valve regions;

a first guard electrode disposed adjacent said outer surface to define a first guard region interposed between said first valve region and said reservoir region;

a second guard electrode disposed adjacent said outer surface to define a second guard region interposed between said second valve region and said reservoir region;

said first and second guard electrodes being electrically connected to said inner electrode to electrically shield said first valve region, said second valve region, and said reservoir region; and means for apply electrical signals to said outer surface through said first and second valve electrodes, said reservoir electrode and said inner electrode, said electrical signals selectively phased such that said valve and reservoir regions expand and contract to pump a fluid through said cavity.

2. The pump of claim 1 further comprising a resilient core sized to fluid-tightly seal said cavity when any one of said tube regions is in an unexpanded state and to allow fluid passage through said tube region when said tube region is in an expanded state.

3. The pump of claim 2 wherein said core has an outer surface attached to said tube inner surface for co-movement with said tube regions and an inner surface defining a core cavity, said pump further comprising a core pin sized to fluid-tightly seal said core cavity when one of said tube regions is in an unexpanded state and to allow fluid passage through said core cavity when said tube region is in an expanded state.

4. A pump comprising:

a piezoelectric ceramic tube having an outer surface and an inner surface;

first, second and third conductive bands attached to said outer surface and being disposed in a spaced apart relationship to one another to define first, second and third tube regions;

an electrode adjacent said inner surface;

a fourth conductive band attached to said outer surface and interposed between said first and second conductive bands;

a fifth conductive band attached to said outer surface and interposed between said second and third conductive bands;

said fourth and fifth conductive bands being electrically connected to said electrode to shield said first, second and third tube regions; and means for applying voltages to said first, second and third conductive bands and to said electrode, said voltages being phased to cause the expansion and contraction of said first, second and third tube regions in sequence to pump a fluid.

5. The pump of claim 4 further comprising an elastomeric core fitted within said ceramic tube and having an inner surface defining a core cavity.

6. The pump of claim 5 further comprising an incompressible core pin within said core cavity.

7. The pump of claim 4 further comprising an incompressible cylindrical core fitted within said ceramic tube.

8. The pump of claim 4 wherein said first and second tube regions are poled oppositely of said third tube region.

9. The pump of claim 4 wherein said means for applying voltages includes means for applying a square wave signal to said tube.

10. The pump of claim 9 wherein said first and second tube regions have the same polarity, and said third tube region has a polarity opposite of that of said first and second tube regions.

11. The pump of claim 4 wherein said first, second and third tube regions have common poling directions.

12. The pump of claim 4 wherein said means for applying voltages includes means for sequential application of voltages to commonly poled first, second and third tube regions.

13. A pump comprising:

a piezoelectric ceramic tube having an outer surface and an inner surface;

an elastomeric core fitted within said ceramic tube and having an inner surface defining a core cavity, where the extremities of said core extend from said tube to enable the attachment of a hose to each said extremity;

first, second and third conductive bands attached to said outer surface and being disposed in a spaced apart relationship to one another to defined first, second and third tube regions;

an electrode adjacent said inner surface; and means for applying voltages to said first, second and third conductive bands and to said electrode, said voltages being phased to cause the expansion and contraction of said first, second and third tube regions in sequence to pump a fluid.

14. A pump comprising:

a piezoelectric ceramic tube having an outer surface and an inner surface;

first, second and third conductive bands attached to said outer surface and being disposed in a spaced apart relationship to one another to define first, second and third tube regions, said first and second tube regions having the same polarity, and said third tube region having a polarity opposite that of said first and second tube regions;

an electrode adjacent said inner surface;

means for applying a square wave voltage to said first, second and third conductive bands and to said electrode, said voltage being phased to cause the expansion and contraction of said first, second and third tube regions in sequence to pump a fluid; and a resistor and diode connected in parallel between said second tube region and said means for applying voltages in order to delay the contraction of said second tube region.

* * * * *